US005085531A

United States Patent [19]

Gillio

[11] Patent Number: 5,085,531

[45] Date of Patent: Feb. 4, 1992

[54] CASSETTE FOR A PRINTING RIBBON FOR TYPEWRITERS

[75] Inventor: Claudio Gillio, Brosso Canavese, Italy

[73] Assignee: Ing. C. Olivetti & C., S.p.A., Ivrea, Italy

[21] Appl. No.: 492,807

[22] Filed: Mar. 18, 1990

[30] Foreign Application Priority Data

Mar. 20, 1989 [IT] Italy ..... 67190 A/89

[51] Int. Cl.[5] ..... B41J 33/52

[52] U.S. Cl. ..... 400/234; 400/208

[58] Field of Search ..... 400/207, 208, 234; 242/75, 75.4, 75.42, 75.43

[56] References Cited

U.S. PATENT DOCUMENTS

| | | | |
|---|---|---|---|
| 4,350,454 | 9/1982 | Schoenlein | 400/208 |
| 4,401,394 | 8/1983 | Hume et al. | 400/208 |
| 4,449,837 | 5/1984 | Craft | 400/208 |
| 4,780,011 | 10/1988 | Hasegawa | 400/208 |

FOREIGN PATENT DOCUMENTS

| | | | |
|---|---|---|---|
| 0031278 | 2/1986 | Japan | 400/234 |

OTHER PUBLICATIONS

IBM Technical Disclosure Bulletin, vol. 24, No. 12 May 1982, "Straight Release Wire for Ribbon Cartridge".

*Primary Examiner*—Edgar S. Burr
*Assistant Examiner*—Christopher A. Bennet
*Attorney, Agent, or Firm*—Banner, Birch, McKie & Beckett

[57] ABSTRACT

A cassette for a printing ribbon for typewriters comprises a casing accommodating a supply spool, a receiving spool and a brake and take up device which operates on a tube of the supply spool and on the ribbon which is unwound from the supply spool. The tube is rotatable on a sleeve projecting from the bottom of the casing. The brake and take up device comprises a shoe for applying a braking action to an internal surface of the tube. A wire spring has an intermediate portion which engages in a seat of coupling means of the shoe. In a first position the shoe is urged against the surface of the tube and brakes the supply spool. In a second position the shoe is spaced from the internal surface of the tube and the supply spool is free to rotate. The spring also performs the slack ribbon take-up function and for that purpose comprises an end having an L-shaped bent portion which in turn is engaged with the ribbon to regulate the tension and unwinding of the ribbon which is unwound from the supply spool.

21 Claims, 2 Drawing Sheets

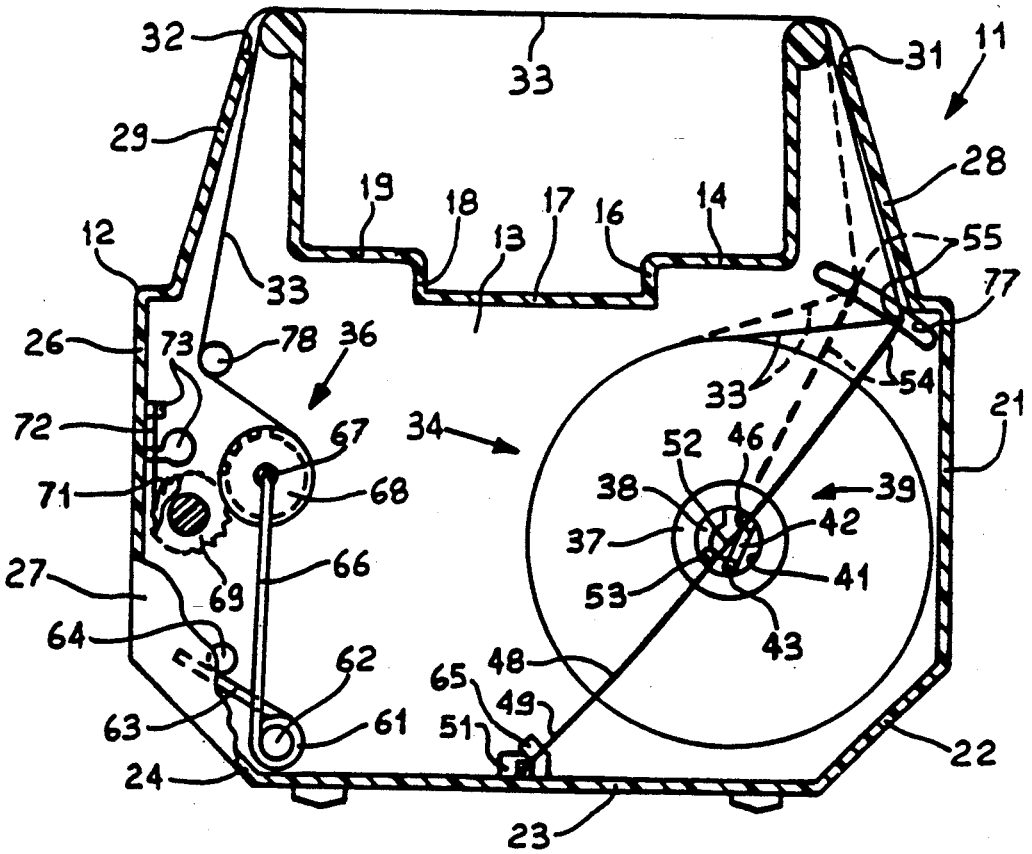
FIG.1
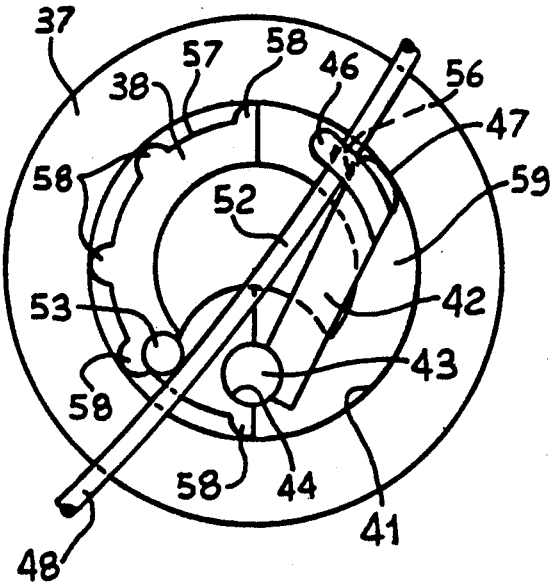
FIG.2
FIG.3
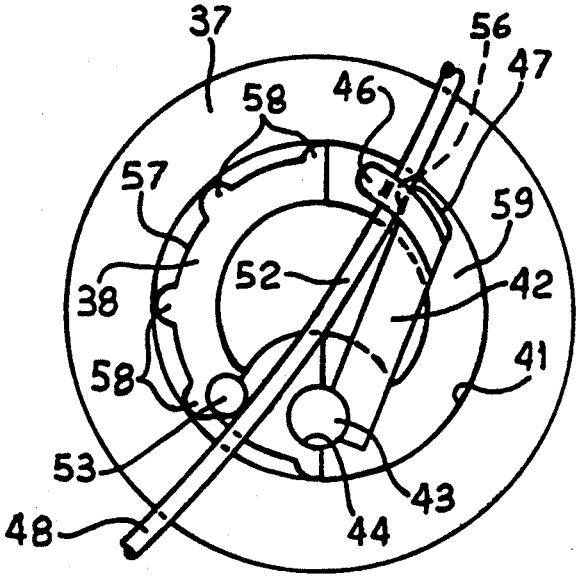

CASSETTE FOR A PRINTING RIBBON FOR TYPEWRITERS

BACKGROUND OF THE INVENTION (1) Field of the Invention

The present invention relates to a cassette for a printing ribbon for typewriters comprising a casing accommodating a supply spool on which the printing ribbon is wound, a receiving spool on to which the ribbon is re-wound after having been used, and a brake and take up device which operates on a tube of the supply spool and on the ribbon which is unwound from said supply spool.

(2) Description of the Prior Art

Published European Patent Application No. 0 075 084 discloses a cassette of this type, in which the brake-take up device comprises an omega-shaped spring which is applied against the external surface of an extension portion of the tube of the supply spool. The omega-shaped spring comprises two arms of which a first arm is fixed to the casing and the second arm has a L-shaped bent portion which is engaged to guide and tension the ribbon as it is unwound from the supply spool. The tension of the spring holds the omega-shaped part bearing against the external surface of the tube and the supply spool is braked. As the ribbon is advanced, the tension of the ribbon causes the second arm of the spring to flex, thereby expanding the omega-shaped part thereof. The latter no longer bears against the external surface of the tube and the supply spool is free to rotate. The second arm of the spring oscillates continuously, tensioning the ribbon which is unwound from the spool and alternating braking actions with release actions.

That device suffers from disadvantages. In fact, in order for the omega-shaped spring to operate effectively, the extension portion of the tube must be of suitable size and thus the cassette will have to be thicker than is necessary, with the result that it is bulky and cumbersome. In addition, the spring being formed by piano wire, engagement of the omega-shaped portion with the extension portion of the tube, after a brief period of operation, gives rise to play between the components. The braking effect decreases whereby there is a reduction in the control over the rotational movement of the supply spool with a lower degree of tensioning of the ribbon.

U.S. Pat. No. 4,505,605 also discloses a cassette for a printing ribbon in which the brake-take up device comprises two springs. A first spring has one end bent at an angle of 90° and introduced into a central hole in a supply spool. The tension of the ribbon holds the external part of the ribbon which is wound on the supply spool constantly pressed against a wall of the container to apply friction to the ribbon and keep it at a predetermined tension. For that purpose a part of the wall has a series of projections or ribs projecting from the wall by variable amounts such as to compensate for the variations in tension of the spring due to the reduction in diameter of the supply spool. A second spring is engaged with the ribbon which is unwound from the supply spool, to perform the function of providing a take-up effect and tensioning of the ribbon. That brake-take up device also suffers from disadvantages. Indeed, during printing cycles in which the ribbon is advanced, the rubbing effect on the ribbon which is pressed against the projections or ribs due to the action of the first spring causes wear at the outside surface of the ribbon, with the risk of losing pigments. In addition, with the ribbon being of greatly reduced thickness, it undergoes deformation to such an extent as to have parts which become limp, causing a deterioration in the quality of printing.

SUMMARY OF THE INVENTION

The object of the present invention is therefore that of providing a cassette for a printing ribbon which is simple, reliable in use and of limited bulk and which makes it possible for the ribbon always to be correctly tensioned both in the rest position and in the operating position and which ensures printing of optimum quality.

The cassette of the present invention has a brake shoe movable within the tube of the supply spool and coupling means between the brake shoe and a take-up element of the brake-take up device. The coupling means produce a braking action of the shoe against the internal surface of the tube in response to a slackening action on the part of the ribbon as it is unwound from the supply spool on to the take-up element.

BRIEF DESCRIPTION OF THE DRAWINGS

The following description sets forth a preferred embodiment of the invention which is given by way of non-limiting example, with reference to the accompanying drawings in which:

FIG. 1 is a partial plan view of a cassette for a printing ribbon with a brake-take device according to the invention, FIG. 2 is a partial plan view of some details from FIG. 1 in an operative position on an enlarged scale, FIG. 3 is a partial plan view of the FIG. 2 details in another operative position.

DESCRIPTION OF THE PREFERRED EMBODIMENT

Figure 4:
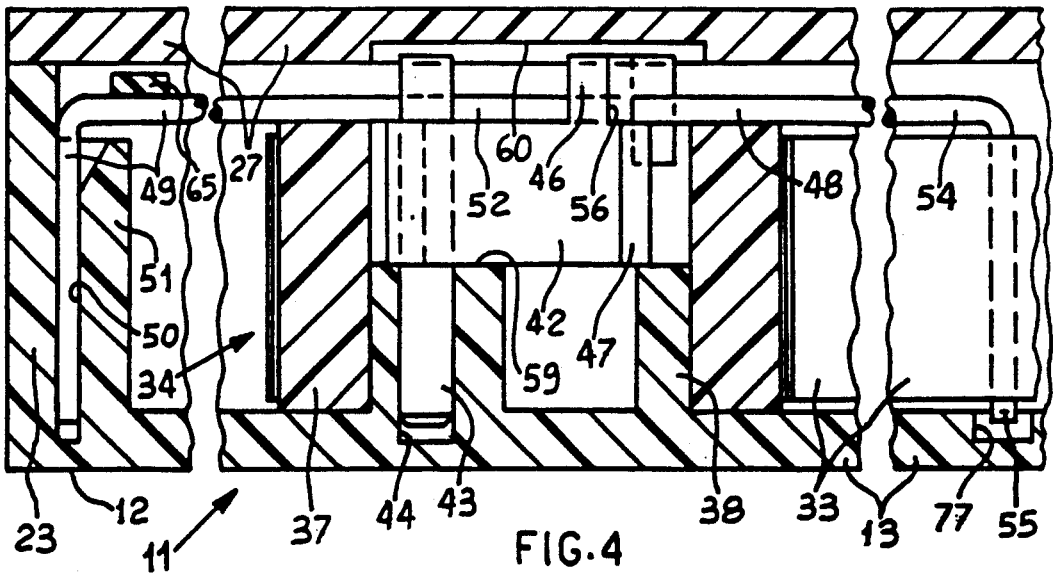
FIG. 4 is a view in section on an enlarged scale of part of the cassette shown in FIG. 1.
Figure 5:
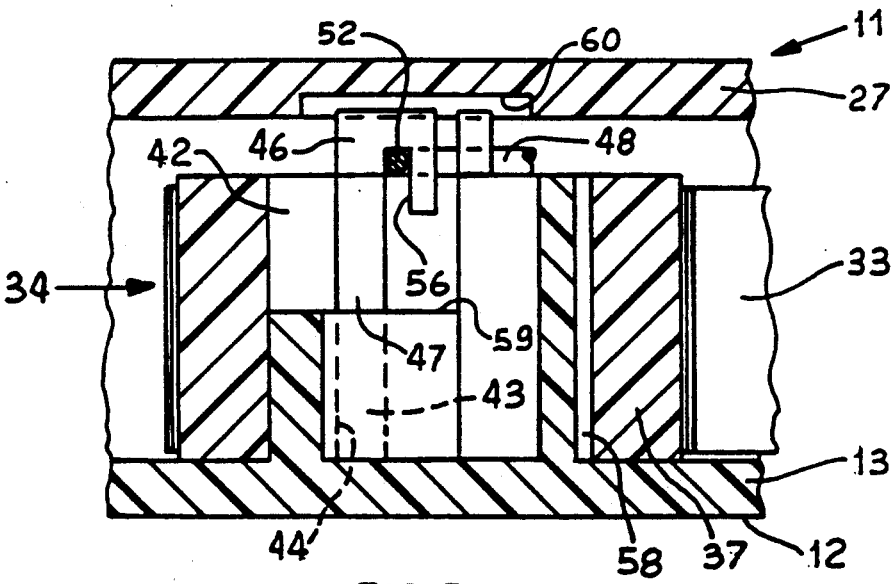
FIG. 5 is a partial front view of some details from FIG. 4.

Referring to FIG. 1, a cassette for a printing ribbon is generally indicated by reference numeral 11 and comprises a casing 12 of plastics material, having a bottom 13, rear walls 14, 16, 17, 18 and 19, two right-hand side walls 21 and 22, a front wall 23 and two left-hand side walls 24 and 26. The casing 12 is closed upwardly by a cover 27 and comprises two arms 28 and 29 projecting from the rear walls 14 and 19, having two openings 31 and 32 which each permit a printing ribbon 33 to pass therethrough.

The casing 12 is capable of accommodating a supply spool generally indicated by reference numeral 34 and on to which the ribbon 33 is wound, and a receiving spool generally indicated by reference numeral 36, on to which the ribbon 33 is wound again after having been used. The supply spool 34 is rotatable by means of a tube 37 on a sleeve 38 projecting from the bottom 13 of the casing 12.

A brake and take up device generally indicated by reference numeral 39 operates and co-operates with an internal surface 41 of the tube 37 and comprises a brake shoe 42 which is movable within the tube 37. The brake shoe 42 is pivotally mounted on the sleeve 38 and rotates in both directions by means of a pin 43 (see FIGS.

2, 3, 4 and 5) which is positioned at one end and capable of being accomodated in a hole 44 in the sleeve 38. At the other end the brake shoe 42 comprises coupling means 46 and an external surface 47 co-operable with the internal surface 41 of the tube 37.

The brake-take up device 39 comprises a spring 48 (see FIGS. 1, 2, 3, 4 and 5) of the wire type and having an L-shaped bent end 49 accommodated in a hole 50 in a fixed support 51 of the casing 12. A tongue portion 65 on the casing 12 is normally disposed over the end 49 of the spring 48 and prevents undesired vertical movements of the spring 48.

An intermediate portion 52 of the spring 48 is co-operable with a fixed pin 53 projecting from the sleeve 38 and with the coupling means 46 to provide prestressing of the spring 48. Finally a terminal portion or take-up element 54 of the spring 48 has an L-shaped bent portion 55 against which the ribbon 33 is engaged and guided as it is unwound from the supply spool 34.

The coupling means 46 comprise a fork element on the brake shoe, which defines a seat 56 which can always be engaged by the intermediate portion 52 of the spring 48. The spring 48 is therefore capable of positively controlling the brake shoe 42 to position it from a first position in which it brakes the supply spool 34, as shown in FIG. 2, to a second position in which it permits the supply spool 34 to rotate freely, as shown in FIG. 3, and vice-versa, as will be described in greater detail hereinafter.

The sleeve 38 has an external surface 57 delimited by vertical ribs 58 of semi-cylindrical shape and capable of cooperating over their full height with the internal surface 41 of the tube 37, being such as to reduce the contact surface area as between the sleeve 38 and the internal surface 41 of the tube 37 and to permit an easy sliding movement, even when there are wear particles between the components.

The ribs 58 are positioned only over one half of the circumference of the sleeve 38 and are disposed in opposite relationship to the brake shoe 42. In the half opposite to that provided with the ribs 58, the sleeve 38 has a space delimited by a lowered edge 59, substantially halfway along the height of the tube 37. The hole 44 is provided in the lowered zone and the shoe 42 extends like a flag from the edge 59 to the upper edge of the tube 37 and is supported movably on the edge 59. The seat 56 of the fork element 46 holds the portion 52 in line with the upper edge of the tube 37. The cover 27 also has a recess 60 to permit free movement of the fork element 46.

A wire spring 61 which is pivotally mounted by an intermediate portion thereof about a fixed pin 62 on the bottom 13 has one end 63 engaged against a fixed pin 64 on the bottom 13. The other end 66 of the spring 61 has an L-shaped bent portion which is accommodated in a central hole 67 (see FIG. 1) of a tube 68 of the receiving spool 36. The tension of the spring 66 always holds the tube 68 in a displaced position in which it is pressed, with the ribbon 33 which is being wound on to the receiving spool 36 again, against the teeth of a drive wheel 69 for the unidirectional feed movement of the ribbon 33.

Figure 6:
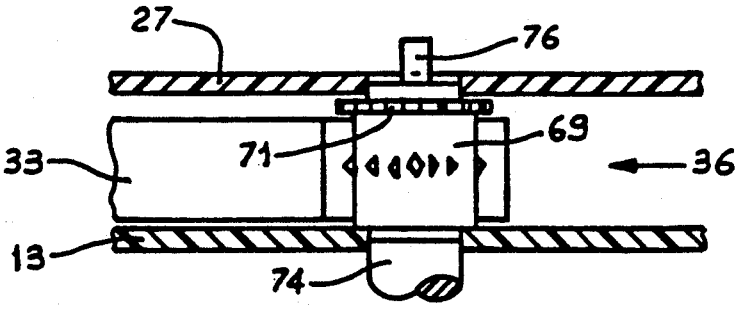
FIG. 6 is a partly sectional view of further details of the FIG. 1 cartridge on an enlarged scale.

The wheel 69 is fixed and coaxial with a sawtooth wheel 71 (see FIGS. 1 and 6) which is positioned at a higher level with respect to the receiving spool 36 and which therefore does not interfere with the ribbon 33 when it is being wound on to the tube 68 again. The sawtoothed wheel 71 co-operates with a resilient blade portion 72 mounted on a fixed support 73 of the casing 12 and capable of preventing rotary movement of the wheel 69 in the reverse direction and thus unwinding of the ribbon 33 from the spool 68.

When the cassette 11 is mounted on a typewriter, the wheel 69 can be coupled to a drive shaft 74 of the machine, which rotates the wheel 69 for the unidirectional feed movement of the ribbon 33. The wheel 69 is also fixed with respect to a gripping portion 76 which projects from the cover 27 for manual feed movement of the ribbon 33.

The casing 12 comprises a through slot or groove 77 (see FIGS. 1 and 4) which is provided in the bottom 13 and which is capable of accommodating the lower end of the L-shaped bent portion 55 of the spring 48 to facilitate the movement of the bent portion and to prevent contact from occurring between the bent portion and the bottom 13. The ribbon 33 is unwound from the supply spool 34, is engaged with the L-shaped bent portion 55 and by way of the opening 31 issues from the casing 12 to pass back into the casing 12 again by way of the opening 32, is guided around a fixed pin 78 on the bottom 13 and is then rewound on to the tube 68 of the receiving spool 36.

When the cassette 11 (see FIGS. 1, 2, 3 and 6) is removed from the typewriter or is mounted but printing cycles are not being performed, the tension of the spring 48 holds the ribbon 33 in a constantly tensioned condition. In addition the intermediate portion 52 holds the brake shoe 48 in its first position in which the external surface 47 is engaged against the internal surface 41 of the tube 37, as shown in FIG. 2. The supply spool 33 will thus be braked.

As soon as the printing cycles begin, the toothed wheel 69 is rotated by the drive shaft 74, for example as described in published European Patent Application No. 0 333 375. The tube 68 of the receiving spool 36 is driven in rotation by the toothed wheel 69 and causes unidirectional forward movement of the ribbon 33. The tension of the ribbon 33 overcomes the tension of the spring 48 and causes the spring 48 to flex by means of the end 54 and the L-shaped bent portion 55. The intermediate portion 52 of the spring 48 then entrains the brake shoe 42 in an anti-clockwise rotary movement and positions it in its second position in which the external surface 47 of the shoe 42 is spaced from the internal surface 41 of the tube 37, as shown in FIG. 3. The supply spool 34 is free to rotate and the ribbon 33 is free to advance. The spring 48 which also performs the function of a take-up means to regulate the tensioning of the ribbon 33, with its end 54 and the L-shaped bent portion 55, will continuously oscillate between intermediate positions delimited by the solid line and the broken line, as shown in FIG. 1, alternating braking actions with slackening actions in regard to the spool 39, while the ribbon 33 is always normally and uniformly tensioned.

As soon as the printing cycles come to an end, the toothed wheel 69 is stopped and the ribbon 33 is not advanced any further, the tension of the spring 48 gradually causes the brake shoe 42 to rotate in the clockwise direction, by means of the intermediate portion 52, to position it in the first position in which the external surface 47 of the shoe 42 is again engaged against the internal surface 41 of the tube 37 and the supply spool 34 is braked. At the same time the spring 48 still continues with its take-up function and by means of the end 54 and the L-shaped bent portion 55 holds the ribbon 33 in a constantly tensioned condition, being resisted by the reverse action applied by the blade portion 72 to the sawtoothed wheel 71.

It will be appreciated that the cassette 11 for the ribbon 33 may be the subject of modifications and improvements both in regard to the shape and the arrangement of the various components and elements without departing from the scope of the present invention.

The brake shoe 42 may be supported by parts of the cover 27 of the casing 12 which are independent of the sleeve 38 on which the tube 37 of the supply spool 34 is rotatably mounted. In addition, the brake shoe 42 may be coupled to the take-up element by means of intermediate cam or lever elements to modify the braking action of the shoe 42 on the tube 37 with respect to the accumulation and tensioning effect applied by the spring 48 to the ribbon 33 as it is unwound from the supply spool 34. For the purposes of its braking action, the shoe 42 may involve a linear movement which is produced by means of sliding couplings rather than rotational couplings.

Finally it will also be apparent that the supports disposed on the casing 12 may also be provided by the cover 27 rather than by the bottom 13, without departing from the scope of the invention.

What is claim is:

1. A cassette for a printing ribbon for typewriters comprising a printing ribbon, a supply spool on which said printing ribbon is wound, said supply spool comprising a tube, a casing accommodating said supply spool, a receiving spool on to which said ribbon is wound again after having been used, and a brake and take up device which operates on said tube of said supply spool and on said ribbon which is being unwound from said supply spool, said device comprising a brake shoe movable within said tube of said supply spool, a take up element and coupling means between said brake shoe and said take up element, said coupling means being operative to provide a braking action of said shoe against the internal surface of said tube in response to a slackening action in respect of said ribbon as it is being unwound from said supply spool on to said take up element, wherein said tube of said supply spool is rotatable on a sleeve projecting from the casing and said brake shoe cooperates with the internal surface of said tube, and wherein said sleeve defines a space delimited by an edge of reduced height with respect to the height of said tube of said supply spool and wherein said brake shoe is accommodated in this space and is partially guided by said edge of reduced height.

2. A cassette according to claim 1, wherein said brake and take up device comprises a wire spring having an intermediate portion and a terminal portion, in which said intermediate portion co-operates with said coupling means to position said brake shoe in a first position in which it brakes said tube and in a second position in which it permits said tube to rotate freely, and in which said terminal portion of said spring co-operates with said ribbon to regulate the tension and the unwinding of said ribbon from said supply spool.

3. A cassette for a ribbon according to claim 2, wherein the tension of said ribbon, when said cassette is mounted on a typewriter and printing cycles are being performed, is such as to overcome the tension of said spring, causing it to flex, whereby said intermediate portion which is engaged with said coupling means can disengage said brake shoe from the internal surface of said tube, permitting said supply spool to rotate freely, and wherein said terminal portion which functions as a take-up element regulates the unwinding and tensioning of said ribbon as it is unwound from said supply spool.

4. A cassette for a ribbon according to claim 3, wherein, as soon as the printing cycles terminate, said spring causes said brake shoe to rotate gradually from said second position to said first position, whereby said shoe is re-engaged with the internal surface of said tube to brake said supply spool, at the same time holding said ribbon in a constantly tensioned condition by means of said terminal portion.

5. A cassette for a ribbon according to claim 2, wherein said brake shoe is pivoted on a portion of said sleeve, rotates in both directions and comprises said coupling means which engage said intermediate portion of said wire spring, and wherein said wire spring positively controls said brake shoe.

6. A cassette for a ribbon according to claim 4, wherein said coupling means define a seat which is always engaged with and coupled to said intermediate portion of said spring.

7. A cassette for a ribbon according to claim 5, wherein said casing comprises a fixed support and said sleeve comprises a fixed pin, wherein said wire spring is pivoted at one end on the fixed support, said intermediate portion of the wire spring cooperates with the fixed pin and with said coupling means for prestressing the wire spring, and said terminal portion of said wire spring has an L-shaped bent portion on which said ribbon is guided and engaged as it is unwound from said supply spool.

8. A cassette for a ribbon according to claim 1, wherein said brake shoe comprises at one end a pin fitted in a hole in said sleeve and comprises at the other end said coupling means and an external surface co-operating with the internal surface of said tube of said supply spool.

9. A cassette for a ribbon according to claim 8, wherein the external surface of said shoe is substantially smooth to co-operate with the smooth internal surface of said tube.

10. A casette for a ribbon according to claim 1, wherein the external surface of said sleeve comprises vertical ribs which are each of semi-cylindrical shape and co-operate with the internal surface of said tube of the supply spool to reduce the area of contact between said sleeve and the internal surface of said tube.

11. A cassette for a ribbon according to claim 10, wherein said ribs are positioned over a half of the circumference of said sleeve and are in opposite relationship to said brake shoe.

12. A cassette according to claim 1, wherein said casing has a recess to permit free movement of said coupling means.

13. A cassette for a printing ribbon for typewriters comprising a supply spool with a tube on which a printing ribbon is wound, said tube having an internal surface; a receiving spool on to which the printing ribbon is wound again after having been used; a brake and take up device which operates on said tube and on the printing ribbon which is being unwound from the supply spool; and a casing having support means for accommodating and rotatably supporting said supply spool and said receiving spool; wherein the brake and take up device comprises a brake shoe fulcrumed in the casing internally to said tube and having an external surface for cooperating with the internal surface of said tube, the improvement comprising an arrest member fixed to the casing near to said tube, coupling means carried by said brake shoe, and a spring wire for regulating the tensioning of the printing ribbon which is being unwound from the supply spool; said spring wire having one end cooperative with the casing, another end cooperative with the printing ribbon which is being unwound from the supply spool, a first intermediate portion cooperative with the arrest member and a second intermediate portion cooperative with said coupling means;

wherein said spring wire is capable of positively controlling the brake shoe to position it from a first position in which said external surface is engaged against the internal surface of the tube and it brakes the supply spool to a second position in which said external surface is spaced from the internal surface and it releases the supply spool to rotate freely; and wherein the spring wire is prestressed to perform the function of a take up element to regulate the tensioning of the printing ribbon with its other end while the printing ribbon unwinds from the supply spool and while the external surface of said brake shoe is in its first position.

14. A cassette for a printing ribbon according to claim 13, wherein the coupling means comprises a fork element which defines a seat and wherein said seat is engaged by the second intermediate portion of said spring wire.

15. A cassette for a printing ribbon according to claim 14, wherein said support means comprise a sleeve having a hole and said arrest member comprises a fixed pin which projects from the sleeve adjacent to said hole, wherein said brake shoe comprises a shoe pin positioned in the hole for rotating the brake shoe in both directions and said shoe pin is positioned opposite to said external surface, and wherein said fixed pin and said seat are positioned opposite each other and cooperative with the first intermediate portion and the second intermediate portion of the spring wire, respectively, for prestressing the spring wire.

16. A cassette for a printing ribbon according to claim 15, wherein the tension of the printing ribbon, when the cassette is mounted on a typewriter and printing cycles are being performed, is such to overcome the tension of the spring wire, causing it to flex before the second intermediate portion moves the brake shoe from the first position to the second position.

17. A cassette for a printing ribbon according to claim 16, wherein as soon as the printing cycles terminate, the tension of the spring wire moves the brake shoe to rotate gradually from the second position to the first position, whereby the external surface is re-engaged with the internal surface of the tube to brake the supply spool, at the same time holding the printing ribbon in a constantly tensioned condition by means of the other end of the spring wire.

18. A cassette for a printing ribbon according to claim 13, wherein said support means comprise a sleeve including vertical ribs which are each of semi-cylindrical shape and cooperate with the internal surface of the tube to reduce the area of contact between the sleeve and the internal surface of said tube.

19. A cassette for a printing ribbon according to claim 18, wherein the vertical ribs are positioned in opposite relationship to the brake shoe.

20. A cassette for a printing ribbon according to claim 13, wherein the casing comprises a slot, wherein the other end of the spring wire has a L-shaped bent portion on which the printing ribbon is guided and engaged as it is being unwound from the supply spool and wherein said slot is provided to accommodate an end of the L-shaped bent portion of said other end to facilitate the free movement of said other end.

21. A cassette for a printing ribbon according to claim 20, wherein said slot is provided in a bottom wall of the casing and wherein said casing further comprises a cover having a recess to permit free movement of said coupling means.

* * * * *